US006859126B2

(12) United States Patent
Iwao et al.

(10) Patent No.: US 6,859,126 B2
(45) Date of Patent: Feb. 22, 2005

(54) NONCONTACT TRANSFORMER

(75) Inventors: Seiichi Iwao, Hikone (JP); Yoshinori Katsura, Hikone (JP); Mikihiro Yamashita, Echi-gun (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/235,645

(22) Filed: Sep. 6, 2002

(65) Prior Publication Data

US 2003/0052764 A1 Mar. 20, 2003

(30) Foreign Application Priority Data

Sep. 14, 2001 (JP) ..... 2001-280083

(51) Int. Cl.[7] ..... H01F 21/04

(52) U.S. Cl. ..... 336/75; 336/118; 336/96; 320/108; 320/115

(58) Field of Search ..... 336/75, 118, 96; 320/108; 108/115

(56) References Cited

U.S. PATENT DOCUMENTS 3,418,552 A 12/1968 Siemens

FOREIGN PATENT DOCUMENTS

| | | |
|---|---|---|
| DE | 1076817 | 3/1960 |
| EP | 0984463 | 3/2000 |

*Primary Examiner*—Lincoln Donovan
*Assistant Examiner*—Jennifer A. Poker
(74) *Attorney, Agent, or Firm*—Greenblum & Bernstein, P.L.C.

(57) ABSTRACT

A non-contact transformer includes a transformer component provided on the floor of a housing, a printed circuit board on the transformer component, and an empty core space is formed within the transformer component wherein deformation of the housing is prevented through a construction that evacuates residual air from the core space when the core space is filled with resin even though both ends of the core space are covered by lid-like parts. A cylindrical end face at one extremity of the primary transformer component is positioned on the bottom plate of the primary housing opposed to the secondary housing, and the printed circuit board is provided on an opposite cylindrical end face which is at the other extremity of the primary transformer component. A passage is formed between the printed circuit board and the primary transformer component to provide a connecting orifice between a core space of primary transformer component and the space external to the primary transformer component.

22 Claims, 7 Drawing Sheets

NONCONTACT TRANSFORMER

BACKGROUND OF THE INVENTION

1. Field of the Invention

The present invention relates to a non-contact transformer in which electrical current is transmitted between non-contacting first and second transformer components located in mutual opposition to each other.

2. Description of Background Information

Conventional transformer T, as shown in FIG. 6, includes a primary transformer component 3 installed within primary housing 2, and secondary transformer component 5 installed within secondary housing 4, the housing being oriented in mutual opposition to each other. Electromagnetic inductance, which occurs between primary coil 8 of primary transformer component 3 and secondary coil 9 of secondary transformer component 5, induces non-contact electrical current transmission between primary transformer component 3 and secondary transformer component 5. Due to its ability to provide non-contact electrical current transmission, non-contact transformer T can be provided for example, in an electrical appliance that is exposed to water such as an electric toothbrush or electric shaver shown as appliance X in FIG. 6, and into charging device Y which is used to electrically charge appliance X. The non-contact transformer allows charging device Y to safely supply electricity to the terminals on appliance X, even when appliance X is wet, without a physical connection being established between appliance X and charging device Y. With primary transformer component 3 installed within primary housing 2 to form charging unity Y, core space 1 is provided in secondary transformer component 5, instead of a solid ferrous core, in order to lower manufacturing costs, and the internal space of primary housing 2 is completely filled with resin 6 (FIG. 7) in order to improve heat dissipation and to waterproof the transformer. When resin 6 is poured into the internal space of primary housing 2, bottom plate 2*a* of primary housing 2 acts as the floor of the housing which is filled with resin 6. Because primary transformer component 3 is completely immersed within resin 6, core space 1 of primary transformer component 3 also becomes filled with resin 6.

It is desirable to bring primary transformer component 3 and secondary transformer component 5 into the closest mutual proximity to each other in order to obtain maximum electromagnetic inductance efficiency. To this end, the cylindrical end faces of primary housing 2 and secondary housing 4 (bottom plate 2*a* and 4*a* in this example) are brought into mutual contact. Terminals 12 are provided at the cylindrical end face of primary transformer component 3 opposite to bottom plate 2*a* of primary housing 2, and printed circuit board 7. As core space 1 is to be filled with resin 6, small gaps are provided between the respective cylindrical end faces of primary transformer component 3 where they meet bottom plate 2*a* of primary housing 2 and printed circuit board 7 in order to allow resin 6 to flow into core space 1. There is an inherent shortcoming, however, in that air core space 1 is a difficult space to fill with resin 6 because air present in core space 1 can become entrapped within resin 6 (residual air 15) with the inflow resin 6. The entrapment of residual air 15 within resin 6 can result in the distortion or breakage of primary housing 2 due to residual air 15 expanding from heat generated by the operation of primary transformer component 3.

SUMMARY OF THE INVENTION

Taking the above inherent problems into consideration, the present invention proposes a structure for non-contact transformer whereby the entrapment of residual air within the resin can be prevented and distortion and damage to the primary housing eliminated even though one side of the transformer core space is covered by the lower plate of the housing and the other side is covered by a printed circuit board.

The non-contact transformer of the present invention provides the following construction. A cylindrically shaped primary transformer component, which is installed within the primary housing, and cylindrically shaped secondary transformer component, which is installed with the secondary housing, are located in mutual opposition. An electromagnetic induction effect, occurring between the primary coil of the primary transformer component and the secondary coil of the secondary transformer component, induces non-contact electrical current transmission between the primary transformer component and the secondary transformer component. A cylindrical end face located on one side of the primary transformer component is attached to a bottom plate of primary housing which is located in opposition to the secondary housing. A printed circuit board, located on the other side of the primary transformer component, is provided on the cylindrical end face to which the terminals are attached. As the transformer component is enveloped within resin which fills the primary housing, a passage is provided between the printed circuit board and the primary transformer component. Even though bottom plate of the primary housing and the printed circuit board define a core space of the primary transformer component as a predominantly covered space, because the passage, which is located between the circuit board and the primary transformer component, provides a connecting space between the core space and the space external to the primary transformer component, the passage is able to guide the flow of resin into the core space while the air present in the core space exits to the space external to the core space at the time when the primary transformer becomes immersed within resin that fills primary housing. The result is that resin is able to flow into the core space of the primary transformer without entrapping residual air (FIG. 7).

The non-contact transformer of the present invention may include the provision of an external orifice which is located opposite to resin inflow point G within the primary housing and which opens to the space external to the primary transformer component at the end of the passage. As a result of this construction, resin will first flow around the external perimeter of the primary transformer component and then into the core space through the passage. That is, after first flowing into the space between the outer perimeter of the primary transformer component and the primary housing, a fairly steady volume of resin will flow smoothly through the passage to the core space. In other words, this structure is able to prevent the passage from becoming suddenly filled by a fast inflow of resin which would prevent air from escaping from the core space. A mechanism is thus formed which created a more stable flow of resin into the core space to further reduce the chances of residual air from the core space becoming entrapped within resin.

The non-contact transformer of the present invention may include the provision of a resin passage, located between the bottom plate of the primary housing and the primary transformer component, that connects the core space to the primary transformer component to the space external to the primary transformer component. The resin passage is thus able to direct the flow of resin from within the primary housing into the core space to the external environment. The separate functions provided by the passage allow for the escape of air from the core space and for the smooth flow of resin into the core space and thus form a mechanism able to further reduce the possibility of trapping the air present in the core space as residual air within resin.

An aspect of the present invention provides a non-contact transformer including a primary cylindrical transformer component provided within a primary housing and a secondary cylindrical transformer component provided within a secondary housing located opposite the primary housing to induce non-contact electrical current transmission between the primary transformer component and the secondary transformer component through electromagnetic inductance occurring between a primary coil in the primary transformer component and a secondary coil in the secondary transformer component, the non-contact transformer including a cylindrical end face of the primary transformer component provided on a bottom plate of the primary housing located opposite the secondary housing; a printed circuit board with terminals attached thereto provided on another cylindrical end face of the primary transformer component; and a passage that receives resin as the primary transformer component is immersed in resin filling the primary housing, the passage provided between the printed circuit board and the primary transformer component and connecting a core space within the primary transformer component and a space external to the primary transformer component.

In a further aspect of the present invention, an external orifice may be provided on the perimeter of the primary transformer component at the passage, the external orifice located on the opposite side of the primary transformer component from where resin is poured into the primary housing. Further, a resin passage may be provided between the primary housing bottom plate and the primary transformer component and connecting a core space within the primary transformer component with a space external to the primary transformer component. An external orifice may further be provided on the perimeter of the primary transformer component at the passage, the external orifice located on the same side of the primary transformer component as where resin is poured into the primary housing. Further, the passage may run in a linear, radial path from the core space within the primary transformer component to the space external to the primary transformer component.

According to a further aspect of the present invention, the primary transformer component includes a coil channel therearound, the cylindrical end face of the primary transformer component provided on the printed circuit board and the coil channel are separated by a distance A, and the depth of the passage from the cylindrical end face of the primary transformer component is B, so that:

$$B<A.$$

According to a further aspect of the present invention, the resin passage provided between the primary housing bottom plate and the primary transformer component runs in a linear, radial path from the core space within the primary transformer component to the space external to the primary transformer component. Further, the primary transformer component may include a coil channel therearound, the cylindrical end face of the primary transformer component provided on the primary housing bottom plate and coil channel are separated by a distance C, and the depth of the resin passage from the cylindrical end face of the primary transformer component provided on the primary housing bottom plate is D, so that:

$$D<C.$$

Further, a first external orifice may be provided on the perimeter of the primary transformer component at the passage between the cylindrical end face of the primary transformer component and the printed circuit board, a second external orifice is provided on the perimeter of the primary transformer component at the resin passage between the primary transformer component and the primary housing bottom plate, and the first external orifice is located on the opposite side of the primary transformer component from the second external orifice.

A further aspect of the present invention provides a primary transformer component for a non-contact transformer, the primary transformer component attached to a bottom plate of a primary housing and including a primary coil, the primary transformer component including a cylindrical end face of the primary transformer component provided on the bottom plate of the primary housing; a printed circuit board with terminals attached thereto provided on another cylindrical end face of the primary transformer component; and a passage that receives resin as the primary transformer component is immersed in resin filling the primary housing, the passage provided between the printed circuit board and the primary transformer component and connecting a core space within the primary transformer component and a space external to the primary transformer component.

A further aspect of the present invention includes in combination, a rechargeable electric appliance; a non-contact transformer; and a primary transformer component.

BRIEF DESCRIPTION OF THE DRAWINGS

The above, and other objects, features, and advantages of the present invention will be made apparent from the following description of the preferred embodiments, given as nonlimiting examples, with reference to the accompanying drawings in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe various embodiments of the present invention with reference to the attached drawings.

Figure 1:
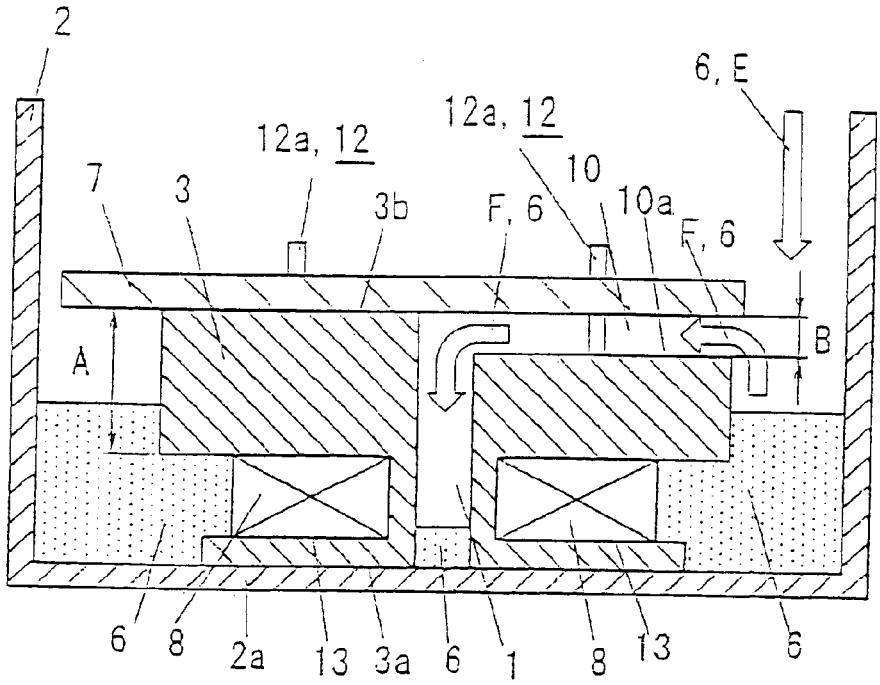
FIG. 1 is an elevational cross-sectional view of the primary a transformer component in the primary housing according to a first embodiment of the present invention.
Figure 2:
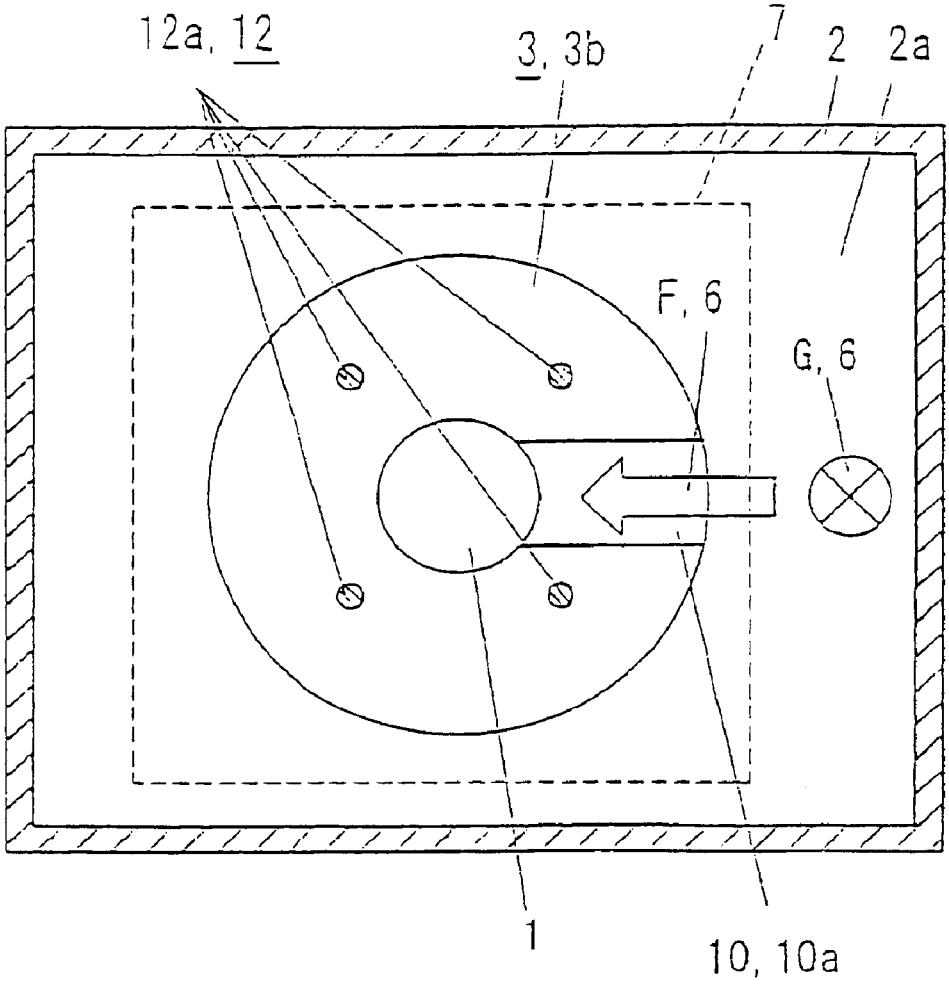
FIG. 2 is a plan view of the primary transformer component of FIG. 1.
Figure 5:
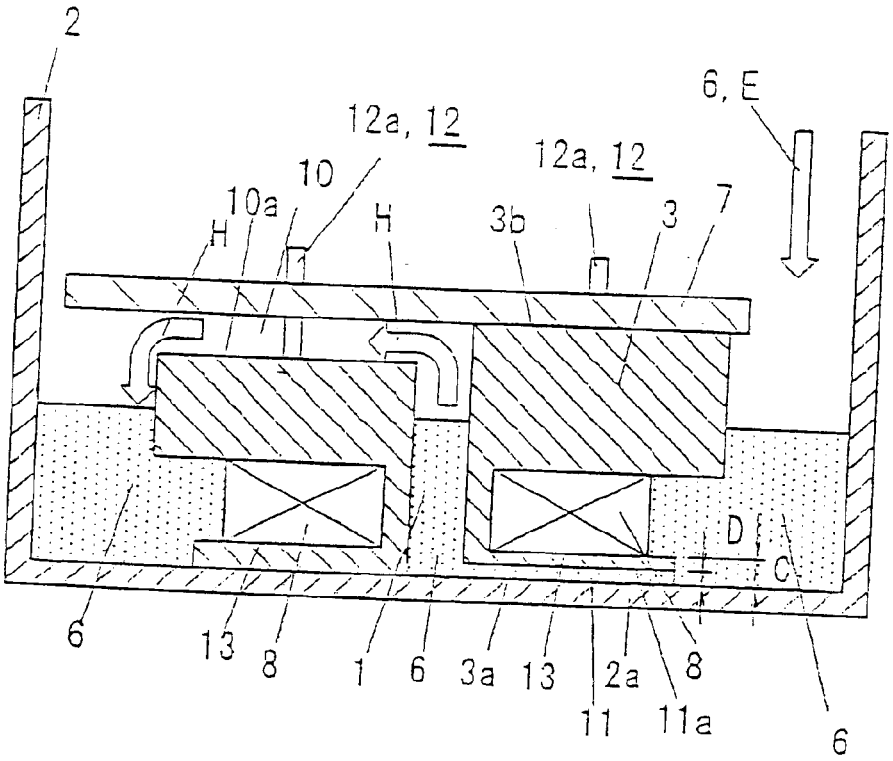
FIG. 5 is an elevational cross-sectional view of a primary transformer component in the primary housing and the resin passage between the primary transformer component and bottom plate of the primary housing according to a third embodiment of the present invention.

FIGS. 1 and 2 illustrate a first embodiment of the present invention. FIGS. 1 and 2 show the positional relationship between primary transformer component 3 and primary housing 2 which form a portion of the structure of a non-contact transformer T. As shown in FIG. 5 and previously described, a prior art non-contact transformer T includes a primary transformer component 3 within primary housing 2, and secondary transformer 5 within secondary housing 4, the transformer components being oriented in mutual opposition. An electromagnetic inductance effect, which occurs between primary coil 8 of primary transformer component 3 and secondary coil 9 of secondary transformer component 5, propagates non-contact electrical current transmission between primary transformer component 3 and secondary transformer component 5. Because of the non-contact electrical current transmission effect that it provides, non-contact transformer T may be used in electrical appliances that are exposed to water such as for example, an electric toothbrush or electric shaver shown as appliance X in the figures, and in charging device Y which is used to electrically charge appliance X.

In the first embodiment, non-contact transformer T is incorporated into a water-exposed electrical appliance X and into charging device Y which is used to electrically charge appliance X. In such an application, primary housing 2 may be called the charging unit housing and primary transformer component 3 the charging unit transformer component. Also, secondary housing 4 may be called the appliance housing and secondary transformer component 5 the appliance transformer component.

Non-contact transformer T includes primary transformer component 3 and secondary transformer component 5 which are cylindrical bodies, each incorporating core space 1, and each incorporating a coil portion formed from electrical wire wound around a portion of each body. Primary transformer component 3 and secondary transformer component 5 are positioned in mutual opposition to each other, that is, the cylindrical end surfaces of each cylindrical body are in mutually facing proximity with the centers of core spaces 1 in axial alignment. The coil portions are positioned at locations in the cylindrical bodies adjacent to the opposing cylindrical end surfaces. More particularly, a coil portion is formed from electrical wire that is wound within coil channel 13 which occupies a space forced radially inward from the perimeter of the cylindrical body. The coil of primary transformer component 3 may be called primary coil 8, and the coil of secondary transformer component 5 may be called secondary coil 9.

As explained above, electricity passing through primary coil 8 generates electrical current in secondary coil 9 through an electromagnetic inductance effect. That is, electrical current is transmitted between primary coil 8 and secondary coil 9 without any physical connection being made between the coils. In this embodiment, primary coil 8 and secondary coil 9, which are within primary transformer 3 and secondary transformer 5, respectively, are located in close mutual opposition. In other words, the mutually proximal location of primary coil 8 and secondary coil 9 form a structure that prevents a reduction in the electrical transmission efficiency of non-contact transformer T. Further, while primary transformer component 3 is within primary housing 2, and secondary transformer component 5 is within secondary housing 4, the mutually opposing cylindrical end faces of primary transformer component 3 and secondary transformer component 5 are positioned in contact with bottom plates 2*a* and 4*a* of primary housing 2 and secondary housing 4, respectively, in order to locate primary coil 8 and secondary coil 9 in extremely close mutual proximity.

In the present invention, the cylindrical end face of primary transformer component 3 that is in contact with bottom plate 2*a* of primary housing 2 is the cylindrical end face 3*a*. Terminals 12 are formed from wire lead terminals 12*a* that extend upward from cylindrical end face 3*b* which is located on the side of transformer component 3 not in contact with bottom plate 2*a* of primary housing 2. Terminals 12 are electrically connected to printed circuit board 7 which is provided on cylindrical end face 3*b* on primary transformer component 3. In other words, primary transformer component 3 is sandwiched between bottom plate 2*a* of primary housing 2 and printed circuit board 7 at cylindrical end faces 3*a* and 3*b*, respectively. Core space 1 connects the space between cylindrical end faces 3*a* and 3*b*, while bottom plate 2*a* of primary housing 2 and printed circuit board 7 each substantially cover opposite ends of core space 1. This embodiment of the present invention also includes channel 10*a* which is formed within cylindrical end face 3*b* located on one end of primary transformer component 3. Channel 10*a* runs in a direct linear radial path from the upper end of core space 1 to the area external to primary transformer component 3. To further explain the structure of the cylindrical body of primary transformer component 3, taking the distance from cylindrical end face 3*b* to coil channel 13 as A, and the depth of channel 10*a* as B, the relationship between A and B is shown by the expression B<A. With printed circuit board 7 provided on cylindrical end face 3*b*, the open upper part of channel 10*a* is covered by circuit board 7 to form passage 10 that provides a linear radial path directly connecting the upper part of core space 1 to the space external to primary transformer 3.

Figure 7:
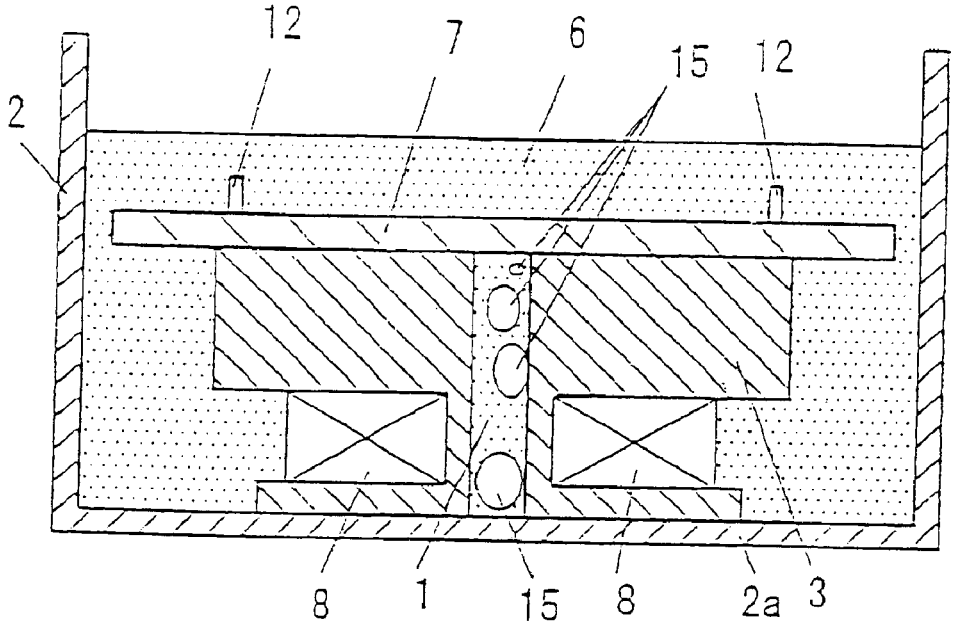
FIGURE 7 PRIOR ART
FIG. 7 is an elevational cross-sectional view of a conventional non-contact transformer depicting residual air entrapped during molding.
Figure 1:
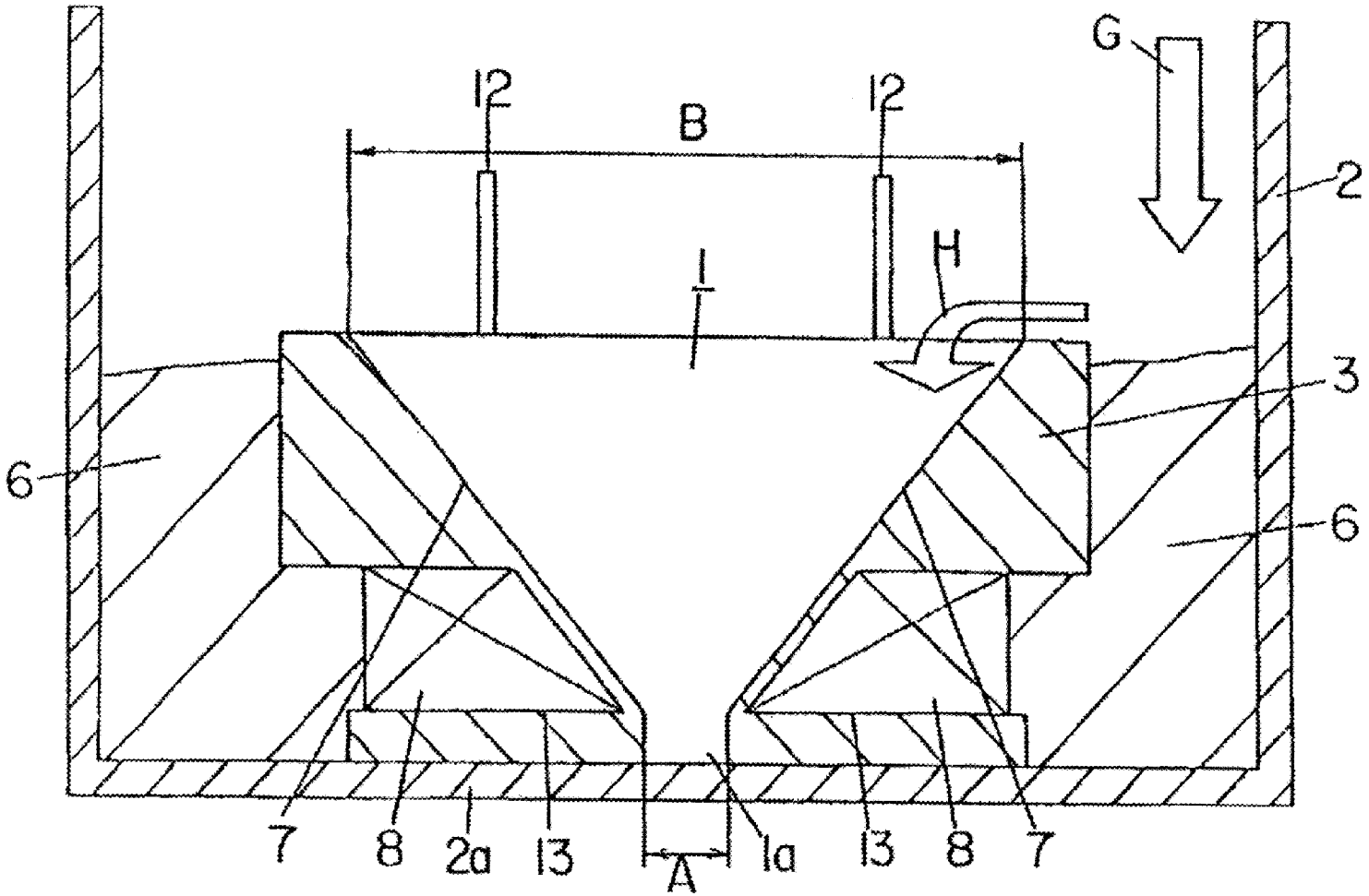
Figure 2:
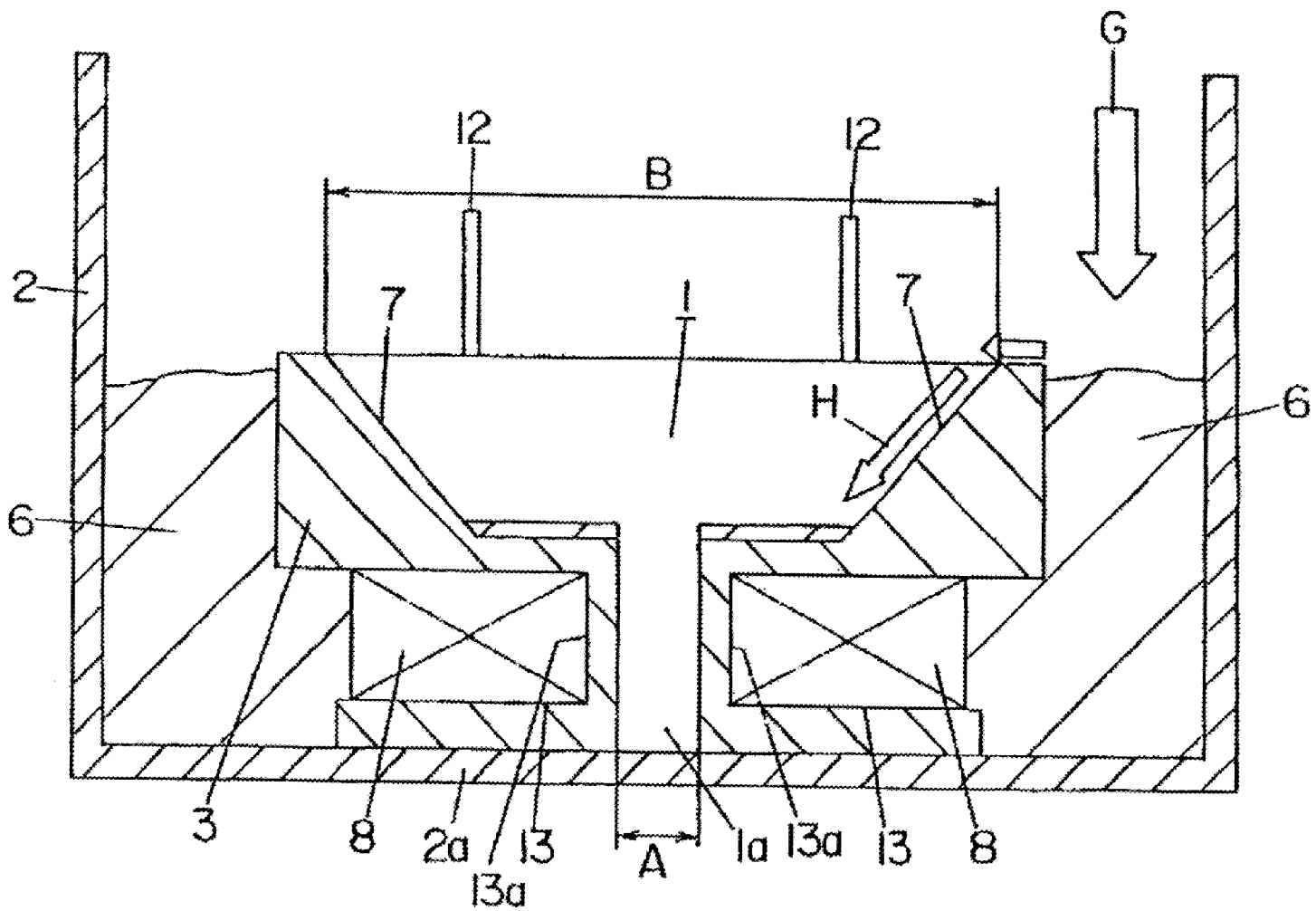
Figure 3:
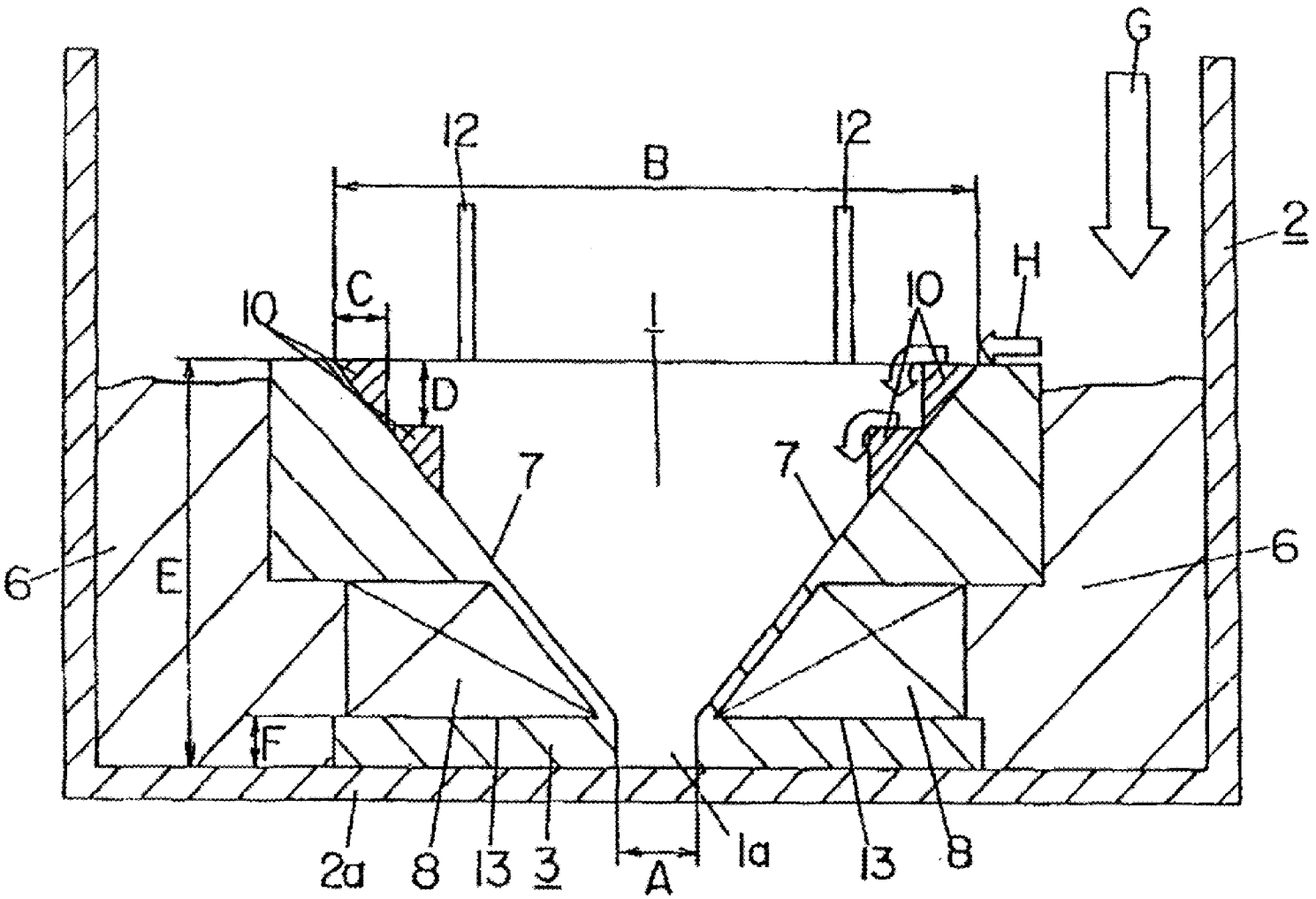
Figure 4:
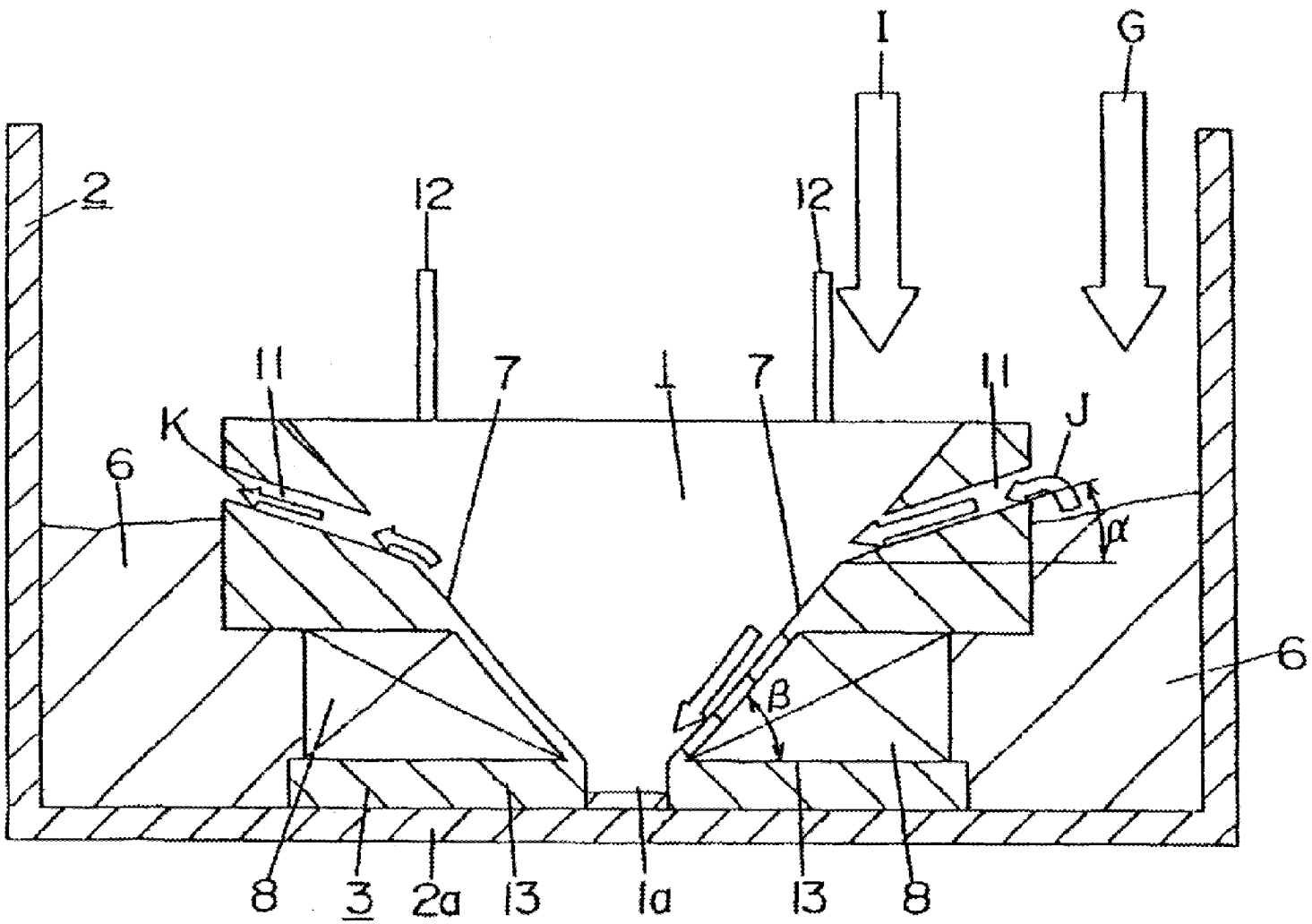
Figure 5:
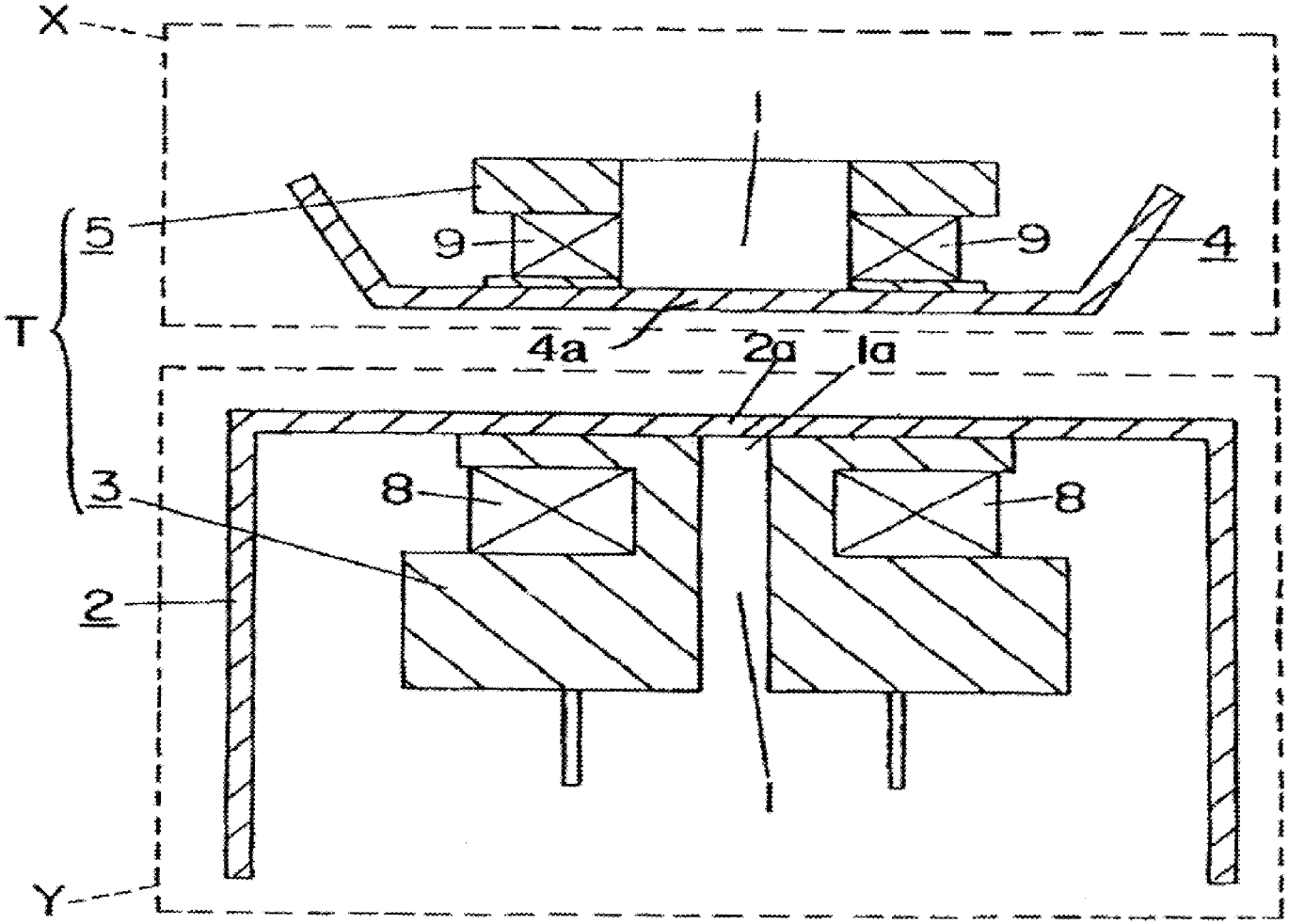
FIGURE 5 PRIOR ART
Figure 6:
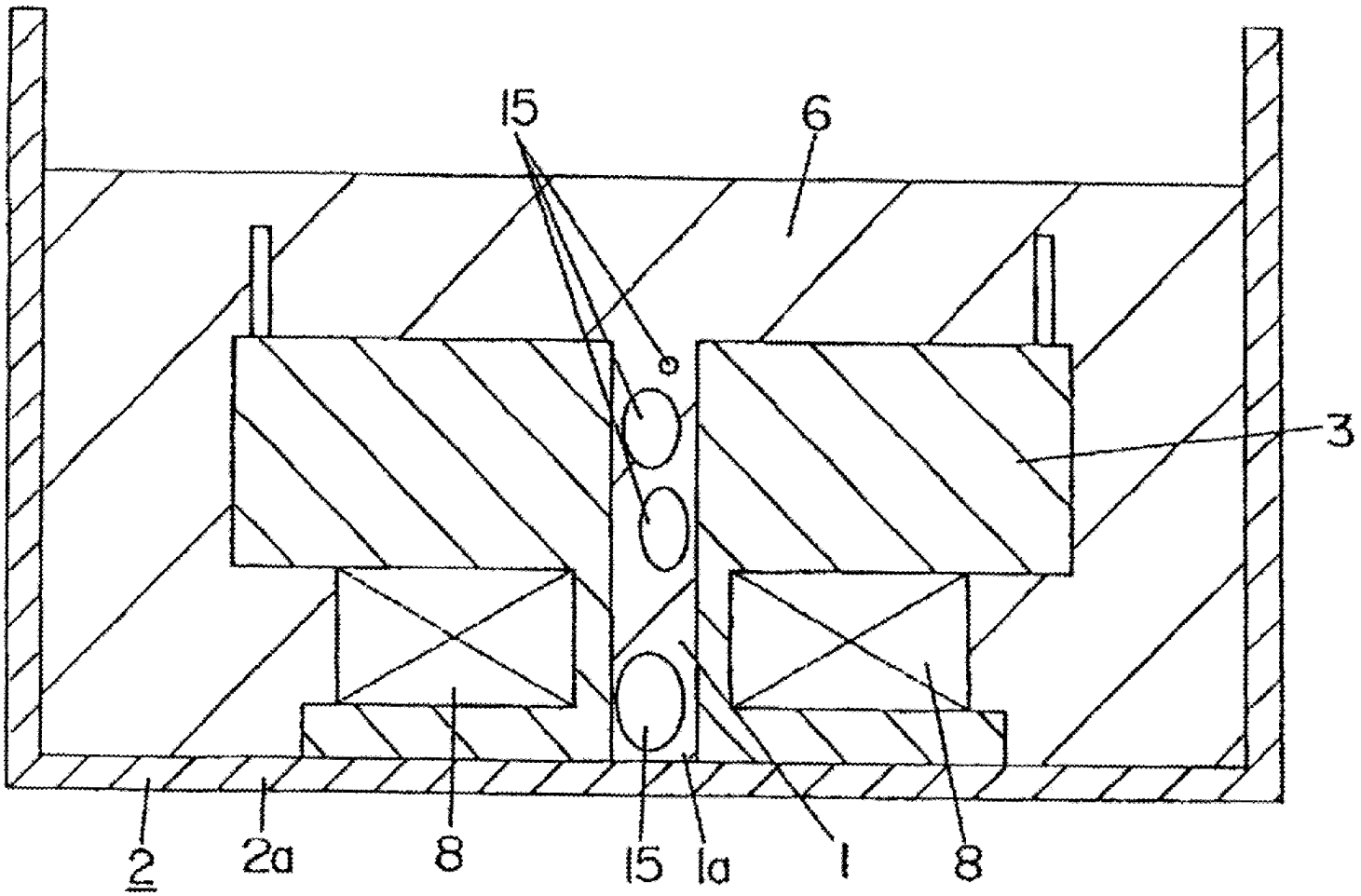
FIGURE 6 PRIOR ART

Primary transformer component 3 is completely embedded in resin 6 which is poured into primary housing 2 as in the conventional practice. When resin 6 fills the internal space of primary housing 2, bottom plate 2*a* of primary housing 2 acts as the bottom of a container into which resin 6 flows in the space between primary housing 2 and an area external to the cylindrical perimeter of primary transformer component 3 (arrow 'E'). As resin 6 flows into primary housing 2 and completely envelopes primary transformer component 3, core space 1 will also become filled with resin 6. That is, resin 6 gradually flows into the space between primary housing 2 and the cylindrical perimeter of primary transformer component 3, and then enters passage 10 from where it gradually flows into core space 1 (arrow 'F'). Even though core space 1 within primary transformer 3 is substantially covered by bottom plate 2*a* of primary housing 2 and printed circuit board 7, the provision of passage 10, which connects core space 1 to a space external to primary transformer component 3 between printed circuit board 7 and primary transformer component 3, prevents the entrapment of residual air 15 (see FIG. 7) within resin 6 in core space 1 of primary transformer component 3 at the time when primary transformer component 3 is being immersed in resin 6 flowing into primary housing 2. The entrapment of residual air 15 is avoided by passage 10 guiding the flow of resin 6 into core space 1 while the air within core space 1 is allowed to escape to an area external to core space 1. Even though the operation of primary transformer component 3 generates heat, distortion or other damage to primary housing 2, which can result from thermally induced expansion of residual air 15 trapped within resin 6, is thus prevented.

The following discussion will explain an additional embodiment of the present invention, but will omit descriptions of structures that do not substantially differ from the previous embodiment, and will only explain those parts of primary transformer component 3 that have been modified from the previous embodiment.

Figure 3:
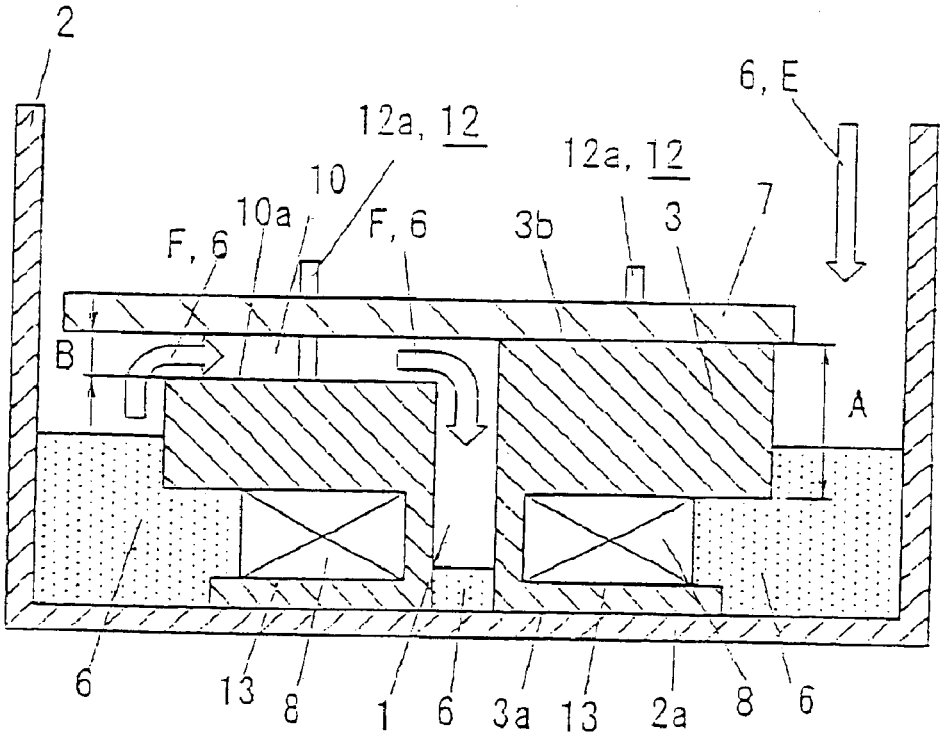
FIG. 3 is an elevational sectional view of the primary transformer component in the primary housing and the biflow passage between the primary transformer and printed circuit board according to a second embodiment of the present invention.
Figure 4:
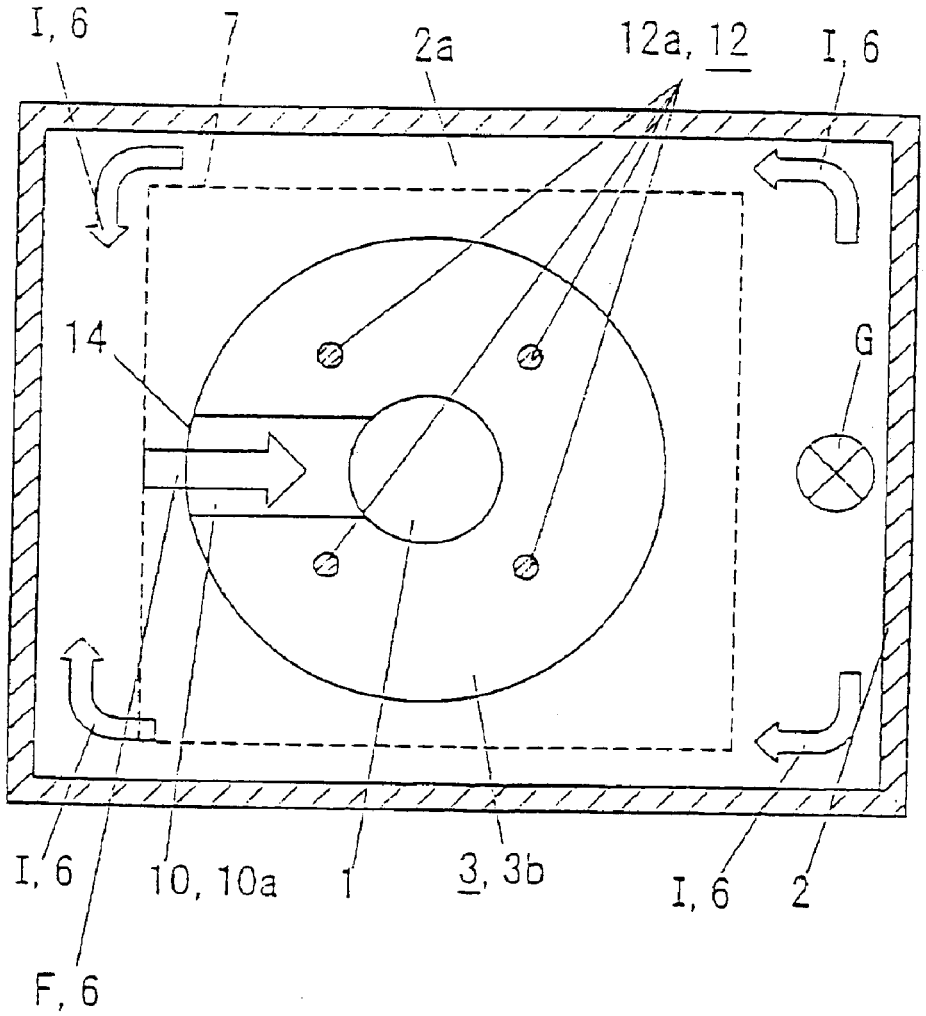
FIG. 4 is a plan view of the primary transformer component of FIG. 3.

FIGS. 3 and 4 illustrate a second embodiment of the present invention in which external orifice 14 is formed at passage 10 on the outer perimeter of primary transformer component 3 opposite to point G where resin 6 is poured into primary housing 2.

As explained in the previous embodiment, passage 10 provides a path for air within core space 1 to escape to a space external to core space 1 and also provides a path for the inflow of resin 6 from primary housing 2 into core space 1. In other words, passage 10 provides a path for both resin 6 and air in order to fulfill these functions. Resin 6 flows into primary housing 2 and gradually accumulates on bottom plate 2*a* of primary housing 2. The impact of resin 6 flowing into the area around point G can have an effect on the already accumulated resin in the form of a resin wave. It is possible for this wave of resin 6 to completely block orifice 14 at the point where passage 10 meets the external perimeter of primary transformer component 3. If a wave of resin 6 should block external orifice 14 in this matter, the airflow path provided by passage 10 to the space external to primary transformer component 3 is cut off, and the inflow of resin 6, which is devoid of residual air 15, to core space 1 is prevented.

Because this embodiment locates external orifice 14 of passage 10 at the external perimeter of primary transformer component 3 opposite to point G where resin 6 is poured into primary housing 2, resin 6 enters primary housing 2 by first flowing and accumulating around the external perimeter of primary transformer component 3 before entering passage 10 (arrow I), and is thus able to flow smoothly at a fairly steady rate to core space 1 without blocking passage 10. As this embodiment locates orifice 14 on the external perimeter of primary transformer component 3 at passage 10 opposite to point G where resin 6 flows into primary housing 2, it becomes possible to further reduce the chance of residual air 15 becoming entrapped within resin 6 in core space 1 when resin 6 is poured into primary housing 2.

FIG. 5 illustrates a third embodiment of the present invention whereby, in addition to passage 10, resin passage 11 is provided between bottom plate 2*a* of primary housing 2 and primary transformer component 3 to connect core space 1 of primary transformer component 3 to the space external to transformer component 3. In this embodiment, channel 11*a* forms a direct linear radial connection between the lower end of core space 1 at cylindrical face 3*a* of primary transformer component 3 and the space external to primary transformer component 3. Resin passage 11 is formed from channel 11*a*. In regard to the structure of channel 11*a*, with cylindrical end face 3*a* of primary transformer 3 on bottom plate 2*a* of primary housing 2, the lower opening of channel 11*a* is covered by bottom plate 2*a* of primary housing 2. Resin passage 11 thus provides a directly connecting linear radial orifice between the lower end of core space 1 and the perimeter of primary transformer component 3. Furthermore, in regard to the cylindrical body that comprises primary transformer component 3, with dimension C denoting the distance from cylindrical end face 3*a* to coil channel 13, and dimension D denoting the depth of channel 11*a*, the relationship between dimensions C and D is expressed as D<C.

In the structure described above, the provision of resin passage 11 between bottom plate 2*a* of primary housing 2 and primary transformer component 3 makes it possible for resin 6 to flow without the inclusion of residual air 15. With resin 6 flowing into primary housing 2 and gradually accumulating on bottom plate 2*a*, the provision of resin passage 11 in the vicinity of bottom plate 2*a* results in resin 6 filling core space 1 (through resin channel 11) and primary housing 2 at approximately the same rate. While the inflow of resin 6 forcibly pushes the air within core space 1 in an upward direction, the upwardly pushed air is discharged to a space external to core space 1 through passage 10 which is located between cylindrical face 3*b*, located at the other end of primary transformer component 3, and printed circuit board 7 (arrow H). In this embodiment, the air within core space 1 discharges through passage 10 to a space external to core space 1 while resin 6 fills core space 1 through resin passage 11. That is, the two passages provide separate functions that allow resin 6 to flow smoothly into core space 1 while reducing the chances of the air within core space 1 becoming entrapped within resin 6.

The non-contact transformer of the present invention provides a structure in which a cylindrical end face on one end of a primary transformer component is attached to a primary housing located in opposition to a secondary housing, and in which a printed circuit board with attached terminals is provided on the cylindrical end face of the other end of the primary transformer component. With the primary transformer component enveloped in resin that fills the primary housing, a passage is provided that connects a primary transformer component core space, located between the printed circuit board and the primary transformer component, with the space external to the primary transformer component. Even though the primary transformer component core space is predominantly covered by lid-like structures in the form of the primary housing bottom plate and the printed circuit board, when the primary transformer component becomes enveloped in resin that has been poured into the primary housing, the passage guides the resin into the core space while also guiding the air within the core space to a space external to the core space. This structure makes it possible for resin to fill the primary housing without the inclusion of air in the resin, and thus prevents thermally induced distortion of the primary housing which can result from heat, generated by the operating primary transformer component, expanding the air entrapped within the resin.

The non-contact transformer of the present invention also includes an external orifice where the passage meets the perimeter of the primary transformer component at a location opposite to the point where resin is poured into the primary housing, thereby forming a structure able to guide the resin through the passage and into the core space after the resin first flows into the primary housing and accumulates around the external perimeter of the primary transformer component. In other words, once the resin flow into the space between the perimeter of the primary transformer component and the primary housing, the resin will then flow smoothly at a fairly steady volume through the passage to the core space. This structure is thus able to prevent a sudden flow of resin that can block the passage and prevent air from escaping from the core space into a space external to the core space, and thus provides a mechanism able to maintain a stable flow of resin into the core space while further reducing the chances of air within the core space becoming entrapped within the inflowing resin.

The non-contact transformer of the present invention includes a resin passage located between the lower plate of the primary housing and the primary transformer component, that connects the core space in the primary transformer component to the space external to the primary transformer component. The resin passage is thus able to guide the flow of resin in the primary housing to the core space while the passage allows air within the core space to simultaneously escape to the space external to the core space. The separate functions provided by each of these passages allow resin to flow smoothly into and fill the core space while air is discharged from the core space to a space external to the core space, thus providing a mechanism able to further reduce the chances of air within the core space from becoming entrapped within the resin that fills the core space.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2001-293596, filed on Sep. 26, 2001, which is herein expressly incorporated by reference in its entirety.

What is claimed is:

1. A noncontact transformer comprising:

a primary transformer component provided within a primary housing and a secondary transformer component provided within a secondary housing, the transformer components being oriented in mutual opposition to induce noncontact electrical power transmission between the primary transformer component and the secondary transformer component through respective primary and secondary coils, and an inclined internal wall defining a core space within the primary transformer component, said inclined internal wall extending from the lower surface of the primary housing to an open end, said open end larger than a portion of said core space at the lower surface of the primary housing, wherein the primary transformer component is attached to a lower surface of the primary housing and is immersed in resin filling the primary housing.

2. The noncontact transformer according to claim 1, wherein the primary transformer component comprises a cylindrical surface parallel to the axis of the primary transformer component, and the primary coil of the primary transformer component comprises electrical wire wound around said cylindrical surface.

3. The noncontact transformer according to claim 1, further including a plurality of stepped portions provided at various diameters within said core space of the primary transformer component, said stepped portions located at specific distances at points of wider opening extending from the lower surface of the primary housing of the primary transformer component to said open end of said core space.

4. The noncontact transformer according to claim 1, further including a plurality of open bores provided within the primary transformer component, each of said plurality of open bores extending from a cylindrical surface to connect to said core space, each of said open bores having a diameter less than a diameter of said core space.

5. The noncontact transformer according to claim 1, wherein said portion of said core space at the lower end of the primary housing defines a floor having a diameter A and said open end of said core space defines a widely open end having a diameter B, so that B is configured to be greater than A.

6. The noncontact transformer according to claim 1, wherein said inclined internal wall of said core space is configured substantially in a cone shape extending from the lower surface of the primary housing with an increasing diameter toward said open end.

7. The noncontact transformer according to claim 5, further including a plurality of stepped portions provided at various diameters within said core space of the primary transformer component, said stepped portions located at specific distances at points of wider opening extending from the lower surface of the primary housing of the primary transformer component to said open end of said core space.

8. The noncontact transformer according to claim 7, wherein each of said plurality of stepped portions has a height dimension parallel to the axial direction of the primary transformer component of D, so that:

$$D \leqq (B-A)/4.$$

9. The noncontact transformer according to claim 7, wherein each of said plurality of stepped portions has a dimension perpendicular to the axial direction of the primary transformer component of C, the primary transformer component has a height E in the axial direction of the primary transformer component, and the lower surface of the primary housing and the primary coil are separated by a distance F, so that:

$$C \leqq (E-F)/2.$$

10. The noncontact transformer according to claim 4, wherein each of said plurality of open bores include an internal wall forming a first angle $\alpha$ with the lower surface of the primary housing and said inclined internal wall defining said core space forms a second angle $\beta$ with the lower surface of the primary housing, so that:

$$0<\alpha<\beta.$$

11. The noncontact transformer according to claim 4, wherein each of said plurality of open bores extends from an external cylindrical surface of the primary transformer component through the primary transformer component toward the lower surface of the primary housing and to said core space, so that each of said plurality of bores is slanted downwardly toward the lower surface of the primary housing.

12. The noncontact transformer according to claim 4, wherein each of said plurality of open bores extends radially from an external cylindrical surface of the primary transformer component through the primary transformer component toward the center of said core space.

13. A primary transformer component for a noncontact transformer, said primary transformer component attached to a lower surface of a primary housing, comprising:

a primary coil: and an inclined internal wall defining a core space within said primary transformer component, said inclined internal wall extending from the lower surface of the primary housing to an open end, said open end larger than a portion of said core space at the lower surface of the primary housing.

14. The primary transformer component according to claim 13, wherein said primary transformer component comprises a cylindrical surface parallel to the axis of said primary transformer component, and the primary coil of said primary transformer component comprises electrical wire wound around said cylindrical surface.

15. The primary transformer component according to claim 13, further including a plurality of open bores provided within the primary transformer component, each of said plurality of open bores extending from a cylindrical surface to connect to said core space, each of said open bores having a diameter less than a diameter of said core space.

16. The primary transformer component according to claim 13, wherein said portion of said core space at the lower end of the primary housing defines a floor having a diameter A and said open end of said core space defines a widely open end having a diameter B, so that B is configured to be greater than A.

17. The primary transformer component according to claim 13, further including a plurality of stepped portions provided at various diameters within said core space of said primary transformer component, said stepped portions located at specific distances at points of wider opening extending from the lower surface of the primary housing of said primary transformer component to said open end of said core space.

18. The primary transformer component according to claim 16, further including a plurality of stepped portions provided at various diameters within said core space of said primary transformer component, said stepped portions located at specific distances at points of wider opening extending from the lower surface of the primary housing of said primary transformer component to said open end of said core space;

wherein each of said plurality of stepped portions has a height dimension parallel to the axial direction of said primary transformer component of D, so that:

$$D \leqq (B-A)/4.$$

19. The primary transformer component according to claim 16, further including a plurality of stepped portions provided at various diameters within said core space of said primary transformer component, said stepped portions located at specific distances at points of wider opening extending from the lower surface of the primary housing of said primary transformer component to said open end of said core space;

wherein each of said plurality of stepped portions has a dimension perpendicular to the axial direction of said primary transformer component of C, said primary transformer component has a height E in the axial direction of said primary transformer component, and the lower surface of the primary housing and the primary coil are separated by a distance F, so that:

$$C \leqq (E-F)/2.$$

20. The primary transformer component according to claim 15, wherein each of said plurality of open bores include an internal wall forming a first angle $\alpha$ with the lower surface of the primary housing and said inclined internal wall defining said core space forms a second angle $\beta$ with the lower surface of the primary housing, so that:

$$0<\alpha<\beta.$$

21. The primary transformer component according to claim 13, wherein said primary transformer component is immersed in resin filling the primary housing.

22. In combination, a rechargeable electric appliance;

a noncontact transformer; and a primary transformer component according to claim 13.

* * * * *

UNITED STATES PATENT AND TRADEMARK OFFICE

CERTIFICATE OF CORRECTION

PATENT NO. : 6,859,126 B2
APPLICATION NO. : 10/235645
DATED : February 22, 2005
INVENTOR(S) : Iwao et al.

It is certified that error appears in the above-identified patent and that said Letters Patent is hereby corrected as shown below:

The Title Page, showing an illustrative Figure, should be deleted and substitute therefor the attached Title Page.

Delete Drawing Sheets 1–7 and substitute therefor the Drawing Sheets consisting of Figs 1-6 as shown on the attached pages.

Please delete Columns 1 Line 1 through Column 12 Line 39 and insert Column 1 Line 1 through Column 12 Line 40 as attached.

Signed and Sealed this

Fifth Day of August, 2008

JON W. DUDAS
*Director of the United States Patent and Trademark Office*

(12) United States Patent
Iwao et al.

(10) Patent No.: US 6,859,126 B2
(45) Date of Patent: Feb. 22, 2005

(54) NONCONTACT TRANSFORMER

(75) Inventors: Seiichi Iwao, Hikone (JP); Yoshinori Katsura, Hikone (JP); Mikihiro Yamashita, Echi-gun (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/235,645

(22) Filed: Sep. 6, 2002

(65) Prior Publication Data

US 2003/0052764 A1 Mar. 20, 2003

(30) Foreign Application Priority Data

Sep. 14, 2001 (JP) ..... 2001-280083

(51) Int. Cl.[7] ..... H01F 21/04

(52) U.S. Cl. ..... 336/75; 336/118; 336/96; 320/108; 320/115

(58) Field of Search ..... 336/75, 118, 96; 320/108; 108/115

(56) References Cited

U.S. PATENT DOCUMENTS 3,418,552 A 12/1968 Siemens

FOREIGN PATENT DOCUMENTS

| | | |
|---|---|---|
| DE | 1076817 | 3/1960 |
| EP | 0984463 | 3/2000 |

*Primary Examiner*—Lincoln Donovan
*Assistant Examiner*—Jennifer A. Poker
(74) *Attorney, Agent, or Firm*—Greenblum & Bernstein, P.L.C.

(57) ABSTRACT

A noncontact transformer installed on the floor of a housing whereby air entrapment within the resin that fills spaces in the transformer is prevented. A primary transformer component is provided on a lower surface of a primary housing, which is then filled with resin. Primary transformer component includes a core space which is defined by inclined internal wall that extends away from the lower surface to form a widely open end of the core space that is larger than the end at the lower surface.

22 Claims, 6 Drawing Sheets

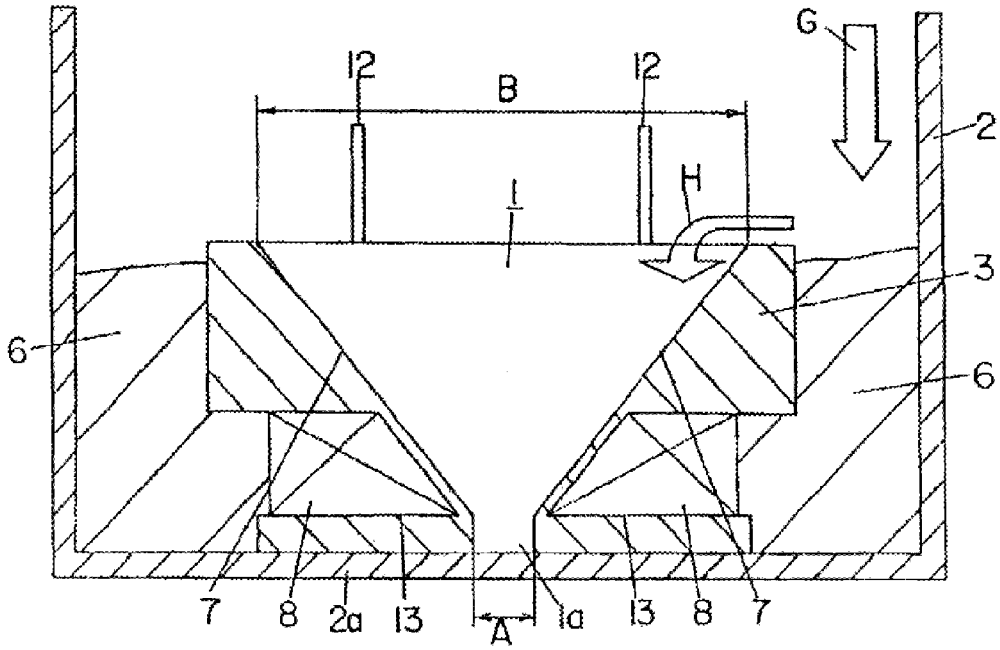

NONCONTACT TRANSFORMER

BACKGROUND OF THE INVENTION

1. Field of the Invention

The invention relates to a noncontact transformer in which electrical power is transmitted through a process of noncontact electromagnetic induction across a region defined by mutually opposing primary and secondary transformers.

2. Description of Related Art

FIG. 5 illustrates the structure of a conventional noncontact transformer T which includes a primary transformer 3 installed within primary housing 2, and secondary transformer 5 installed within secondary housing 4. The transformers are positioned in mutual opposition and are separable from each other. Electromagnetic inductance, which occurs between primary coil 8 of primary transformer 3 and secondary coil 9 of secondary transformer 5, induces noncontact electrical power transmission between primary transformer 3 and secondary transformer 5. Transformer T can, for example, be incorporated into an electrical appliance that is exposed to water such as an electric toothbrush or electric shaver shown as appliance X in the figure, and into charging device Y which is used to electrically charge appliance X. The noncontact transformer allows charging device Y to safely supply electricity to the terminals on appliance X, even when appliance X is wet, without a physical connection being established between appliance X and charging device Y. In order to bring primary transformer 3 and secondary transformer 5 into closest proximity to establish a high degree of electromagnetic induction efficiency for noncontact transformer T, primary transformer 3 and secondary transformer 5 are positioned at the internal sides of the opposing surfaces of primary housing 2 and secondary housing 4, respectively. In order to reduce manufacturing costs, ferrous cores are not installed in core space 1 of primary transformer 3 and secondary transformer 5. Once the primary housing has been specified in relation to charging device Y, primary housing 2 is filled with resin 6 (FIG. 6) which completely surrounds primary transformer 3 to seal out water and improve heat dissipation.

Figure 6:
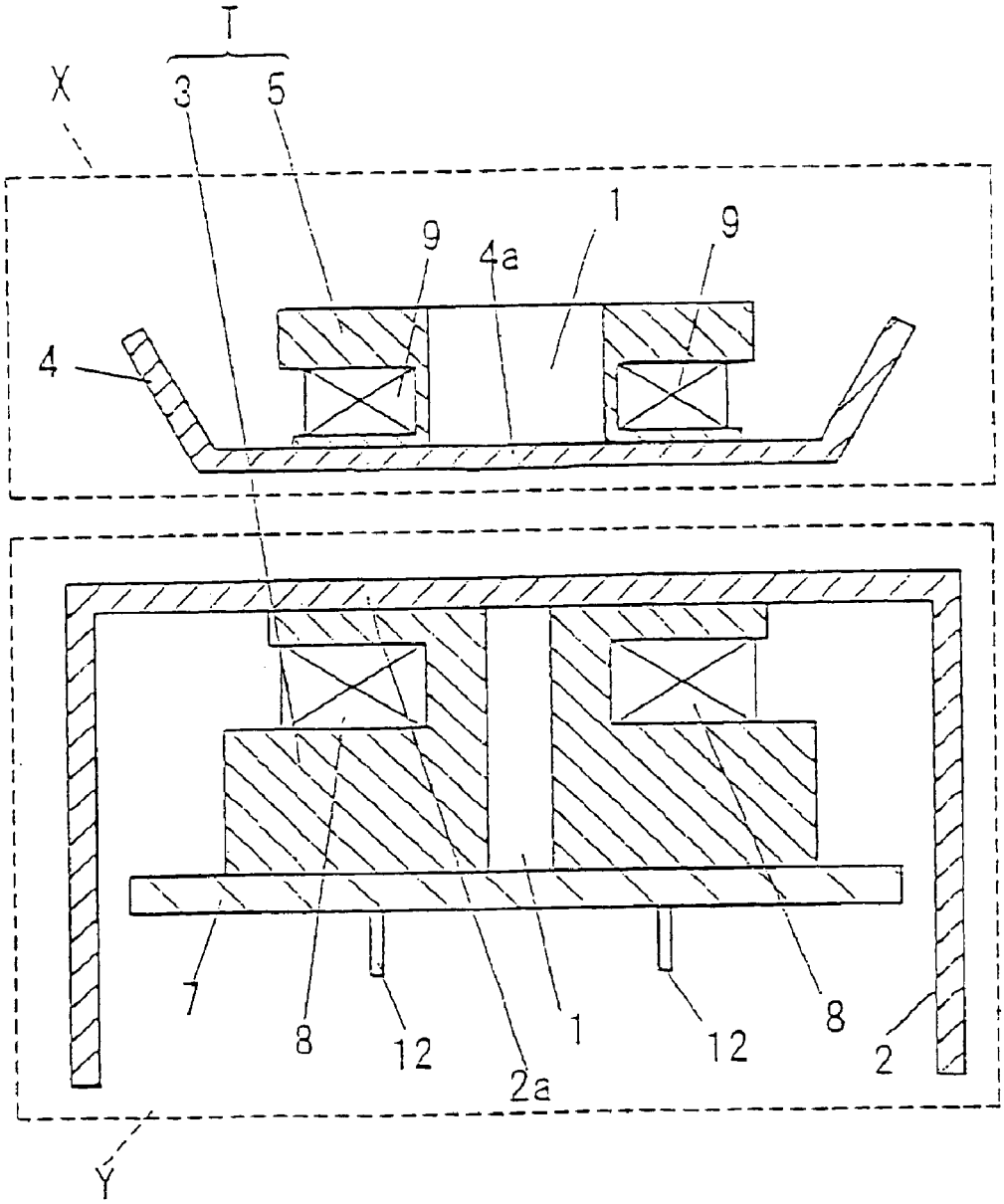
FIGURE 6 PRIOR ART
FIG. 6 is an elevational cross-sectional view of the conventional non-contact transformer.

The prior art has many shortcomings and disadvantages. For example, in cases where resin 6 is used within primary housing 2, resin 6 is poured into the internal area of primary housing 2 opposing lower surface 2*a* which faces secondary housing 4. In order that primary transformer 3 is completely immersed within resin 6, resin 6 must enter core space 1 of primary transformer 3. When resin 6 is poured into core space 1 of primary transformer 3, the air present within core space 1 must have a means of escape to allow the complete inflow of resin 6. Lower surface 2*a* of primary housing 2 forms the closed end of core space 1, and because the narrow open end of core space 1 is small, a dead end passage is formed that makes it difficult for air to escape from the aforesaid narrow open end which in turn makes it difficult for resin 6 to fill primary transformer core space 1. When resin 6 flows into primary transformer core space 1, the air at floor 1*a* cannot escape, thus resulting in residual air 15 remaining within resin 6 (FIG. 6). The continual operation of primary transformer 3 generates heat that causes residual air 15 trapped within resin 6 to expand with the result that primary housing 2 may crack or distort.

SUMMARY OF THE INVENTION

The present invention addresses and resolves air entrapment problems discussed above via, among other things, a noncontact transformer that does not trap air in the hollow transformer core when filled with resin, even though the bottom surface of a housing is attached to the transformer.

The noncontact transformer of the present invention incorporates a primary transformer component installed within a primary housing which is located opposite to a secondary transformer component installed within a secondary housing. As a result of the electromagnetic induction occurring between the primary coil of the primary transformer component and the secondary coil of the secondary transformer component, electrical power is transmitted between the primary transformer component and the secondary transformer component with no physical connection established between the two transformer portions. The primary transformer component is installed within the primary housing which internal area is filled with resin, one extremity of the primary transformer component is attached to a lower surface in the primary housing, and a core space of the primary transformer component is defined by an inclined internal wall that extends outward from the lower surface to form a widely open end of the core space that is larger than the end at the lower surface. As the widely open end of the core space is larger than the closed end at the lower surface, air within the core space is allowed to escape from the side of the core space when resin is poured in, thus making it possible for resin to fill the core space without trapping residual air (see FIG. 6). Furthermore, because the core space incorporates the internal inclined wall, resin flows smoothly into the core space along the aforesaid inclined surface toward the floor, and air within the core space flows out smoothly before the core becomes filled with resin, thus establishing a mechanism able to prevent the entrapment of residual air within resin that fills the core space.

The noncontact transformer of the present invention is further characterized by the coil of the primary transformer component being wound around a cylindrical wall parallel to the axial center of the primary transformer component. This structure, in which the primary coil is wound around the external wall of a cylindrical element formed parallel to the axial center of the primary transformer component, simplifies the wire winding operation through which the coil is attached to the primary transformer component. This structure is provided to simplify the manufacturing operation by making the transformer more adaptable to a mass production process.

The noncontact transformer of the present invention is further characterized by a number of step portions formed to various diameters within the core space of the primary transformer component, the step portions being located at levels of gradually increasing diameter extending from the floor of the primary housing of the primary transformer component to the widely open end of the core space. The installation of the step portions within the core space decreases the speed with which resin flows from the widely open end to the bottom of the core space, thus allowing more time for the air in the core space to escape from the widely open end to the exterior region and thus preventing the entrapment of residual air within resin that fills the core space.

The noncontact transformer of the present invention is further characterized by open bores that pass through the primary transformer component from a cylindrical surface to connect to the core space wherein open bores are formed with an internal diameter smaller than that of the core space. This structure, in which resin fills the area between the primary housing and the primary transformer component, allows resin to slowly flow into the core space through open bores which are formed to a smaller diameter than the internal diameter of the core space, allows residual air trapped within resin to escape from resin which fills the core space, and further prevents residual air from being entrapped within the resin which fills the core space.

An aspect of the present invention provides a noncontact transformer including a primary transformer component provided within a primary housing and a secondary transformer component provided within a secondary housing, the transformer components being oriented in mutual opposition to induce noncontact electrical power transmission between the primary transformer component and the secondary transformer component through respective primary and secondary coils, wherein the primary transformer component is attached to a lower surface of the primary housing and is immersed in resin filling the primary housing, the noncontact transformer including an inclined internal wall defining a core space within the primary transformer component, the inclined internal wall extending from the lower surface of the primary housing to an open end, the open end larger than a portion of the core space at the lower surface of the primary housing.

According to a further aspect of the present invention, the primary transformer component includes a cylindrical surface parallel to the axis of the primary transformer component, and the primary coil of the primary transformer component includes electrical wire wound around the cylindrical surface. Further, the noncontact transformer may include a plurality of stepped portions provided at various diameters within the core space of the primary transformer component, the stepped portions located at specific distances at points of wider opening extending from the lower surface of the primary housing of the primary transformer component to the open end of the core space.

Further, a plurality of open bores may be provided within the primary transformer component, each of the plurality of open bores extending from a cylindrical surface to connect to the core space, each of the open bores having a diameter less than a diameter of the core space. The portion of the core space at the lower end of the primary housing may define a floor having a diameter A and the open end of the core space may define a widely open end having a diameter B, so that: $B>A$. Further, the inclined internal wall of the core space may be configured substantially in a cone shape extending from the lower surface of the primary housing with an increasing diameter toward the open end.

According to a further aspect of the present invention, the noncontact transformer may include a plurality of stepped portions provided at various diameters within the core space of the primary transformer component, the stepped portions located at specific distances at points of wider opening extending from the lower surface of the primary housing of the primary transformer component to the open end of the core space. Each of the plurality of stepped portions may have a height dimension parallel to the axial direction of the primary transformer component of D, so that: $D \leqq (B-A)/4$. Further, each of the plurality of stepped portions may have a dimension perpendicular to the axial direction of the primary transformer component of C, the primary transformer component may have a height E in the axial direction of the primary transformer component, and the lower surface of the primary housing and the primary coil may be separated by a distance F, so that: $C \leqq (E-F)/2$.

In a further aspect of the present invention, each of the plurality of open bores may include an internal wall forming a first angle $\alpha$ with the lower surface of the primary housing and the inclined internal wall defining the core space may form a second angle $\beta$ with the lower surface of the primary housing, so that: $0<\alpha<\beta$. Further, each of the plurality of open bores may extend from an external cylindrical surface of the primary transformer component through the primary transformer component toward the lower surface of the primary housing and to the core space, so that each of the plurality of bores is slanted downwardly toward the lower surface of the primary housing. Further, each of the plurality of open bores may extend radially from an external cylindrical surface of the primary transformer component through the primary transformer component toward the center of the core space.

A further aspect of the present invention includes a primary transformer component for a noncontact transformer, the primary transformer component attached to a lower surface of a primary housing and including a primary coil, the primary transformer component including an inclined internal wall defining a core space within the primary transformer component, the inclined internal wall extending from the lower surface of the primary housing to an open end, the open end larger than a portion of the core space at the lower surface of the primary housing. Further, the primary transformer component may be immersed in resin filling the primary housing.

A further aspect of the present invention provides, in combination, a rechargeable electric appliance; a noncontact transformer; and a primary transformer component.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which:

FIG. 1 is an elevational cross-sectional view of a portion of the noncontact transformer according to one embodiment of the present invention;

FIG. 2 is an elevational cross-sectional view of a portion of the noncontact transformer according to a second embodiment of the present invention;

FIG. 3 is an elevational cross-sectional view of a portion of the noncontact transformer according to a third embodiment of the present invention;

FIG. 4 is an elevational cross-sectional view of a portion of the noncontact transformer according to a fourth embodiment of the present invention;

FIG. 5 is an elevational cross-sectional view of a conventional noncontact transformer; and FIG. 6 is an elevational cross-sectional view of the conventional noncontact transformer of FIG. 5 filled with resin.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

FIG. 1 illustrates a noncontact transformer according to the first embodiment of the present invention. FIG. 1 shows the relationship between primary housing 2 and primary transformer component 3 that form a portion of noncontact transformer T. Like elements are denoted by the same reference numerals as in FIG. 5. Noncontact transformer T is formed of primary transformer component 3 within primary housing 2 oppositely facing secondary transformer component 5 within secondary housing 4 (which are not shown in FIG. 1). A noncontact electrical power transmission effect is obtained between primary transformer component 3 and secondary transformer component 5 as a result of electromagnetic inductance that occurs between primary coil 8 in primary transformer component 3 and secondary coil 9 in secondary transformer component 5. This noncontact electrical power transmission effect can be made use of by installing one portion of noncontact transformer T in an electrical appliance that is exposed to water, such as, for example, an electric toothbrush or electric shaver, shown as appliance X in FIG. 5, and in charging device Y which is used to electrically charge appliance X.

This embodiment includes noncontact transformer T as a component of a water exposed electric appliance X and also as a component of a charging device Y that is used to electrically charge appliance X. Therefore, in this case, primary housing 2 becomes the charging device housing, primary transformer component 3 becomes the charging device transformer, secondary housing 4 becomes the electrical appliance housing, and secondary transformer component 5 becomes the electrical appliance transformer.

Primary transformer component 3 and secondary transformer component 5, which together form noncontact transformer T, are formed as respective cylindrical bodies each incorporating core space 1 which includes a central void region formed within each of the two cylindrical bodies. Each cylindrical body is equipped with a wire coil formed from wire wound around a portion of each cylindrical body. Primary transformer component 3 and secondary transformer component 5 are located in mutual opposition with end faces of each cylindrical body being mutually opposed and with the center axis of each core space 1 being mutually aligned on the same linear axis. Furthermore, channel 13 is provided as a coil housing space located in the proximity of the opposing end faces of the cylindrical bodies. To be more specific, channel 13 extends radially from a cylindrical wall portion of the cylindrical body in order to provide a space within which electrical wire can be wound to form the coil. The coil portion of primary transformer component 3 is termed primary coil 8, and the coil portion of secondary transformer component 5 is termed secondary coil 9. Electricity passing through primary coil 8 can be transmitted to secondary coil 9 through an electromagnetic induction effect. That is, electrical power is transmitted between primary coil 8 and secondary coil 9 without any physical connection. In this embodiment, primary coil 8 and secondary coil 9 are in proximity to each other between primary transformer component 3 and secondary transformer component 5. Because primary coil 8 and secondary coil 9 are in proximity to each other, a structure is formed that prevents a fall-off in the electrical transmission efficiency of noncontact transformer T. Reference numeral 12 denotes the terminals that connect to wire leads or a printed circuit board to supply electrical power to primary coil 8. Although primary transformer component 3 and secondary transformer component 5 are installed within primary housing 2 and secondary housing 4, respectively, the distance between primary transformer component 3 and secondary transformer component 5 can be reduced to a minimum by placing lower surface 2*a* of primary housing 2 against lower surface 4*a* of secondary housing 4 when the cylindrical end faces of primary transformer component 3 and secondary transformer component 5 are placed in mutual opposition.

In regard to the shape of core space 1, core space 1 extends from lower surface 2*a* of primary housing 2, which is attached to primary transformer component 3, to the widely open end portion which is larger than the portion of core space 1 at lower surface 2*a*. If the diameter of floor 1*a* of core space 1 is termed A, and the diameter of the widely open end of core space 1 is termed B, the relationship between A and B can be expressed as B>A. In this embodiment, inclined wall 7, as shown in FIG. 1, defines the internal wall of core space 1 which extends from lower surface 2*a* of primary housing 2 with an increasing diameter in the axial direction. In other words, core space 1 is formed as an approximate cone shape as it extends upward toward the widely open end of the core space 1.

In regard to the method of securing primary transformer component 3 within primary housing 2, the internal area of primary housing 2 is completely filled with resin 6 similar to the conventional method. With lower surface 2*a* of primary housing 2 defining the bottom of a container shape, when resin 6 is poured into primary housing 2, resin 6 fills the outer cylindrical portion of primary transformer component 3 between transformer 3 and primary housing 2 (arrow G). In regard to the process through which primary transformer component 3 is embedded in resin 6, when primary transformer component 3 becomes completely immersed in resin 6, core space 1 also becomes filled with resin 6. That is, resin 6 first fills the area between the outer cylindrical part of primary transformer component 3 and primary housing 2, spills over into the widely open end of core space 1, and then gradually fills core space 1 (arrow H). In this embodiment, core space 1 is an approximate cone shape with the widely open end of the cone located at the top. Because core space 1 has a widely open end from which inclined internal wall 7 moves downward toward the smaller end, resin 6 is able to flow smoothly down inclined internal wall 7, from the widely open end toward floor 1*a*, while at the same time allowing air to escape from core space 1. The entrapment of residual air 15 in the prior art device depicted in FIG. 6 within resin 6 in core space 1 is prevented when resin 6 fills the type of cone-shaped core space of the present invention described above. As a result of primary transformer component 3 being immersed within resin 6 (which fills the internal area of primary housing 2) without the inclusion of residual air 15, the effect whereby the expansion of residual air 15 cracks resin 6 or distorts or damages primary housing 2 is eliminated even in the presence of heat generated by the operation of primary transformer component 3.

A second embodiment of the present invention is characterized by a modified shape of the primary transformer component 3. The following explanation refers only to the modified portions of the second embodiment, and does not cover similar structures that have already been explained in the previous embodiment. FIG. 2 illustrates the second embodiment which incorporates a cylindrical wall 13*a*, formed parallel to the axial centerline of primary transformer component 3, around which electrical wire is wound to form primary coil 8. That is, the inner cylindrical surface of channel 13, onto which electrical wire is wound, is formed parallel to the central axis of primary transformer component 3. The operation through which electrical wire is wound onto primary transformer component 3 is simplified due to the inner cylindrical surface of channel 13 being formed parallel with the axial center of transformer 3. This structure provides a significant benefit in terms of the manufacture of primary transformer component 3, especially when the transformer is manufactured through a mass production process in which the electrical wire is mechanically wound around the transformer.

FIG. 3 illustrates a third embodiment of the present invention in which several step portions 10 are formed to various diameters on the wall of core space 1, each step portion 10 being formed at an increasingly larger diameter location of core space 1 extending from the floor of primary housing 2 of primary transformer component 3. In this embodiment, two step portions 10 form a stepped structure that is added to inclined internal wall 7 in proximity to the widely open end of core space 1. With dimension E denoting the height of primary transformer component 3 in the axial direction, and dimension F denoting the distance from the floor of primary housing 2 to primary coil 8 of primary transformer component 3, dimension D, which denotes the height of each step 10, is calculated as $D \leqq (B-A)/4$. Furthermore, width dimension C of each step portion 10 is calculated as $C \leqq (E-F)/2$. The addition of step portions 10 into core space 1 has the effect of further slowing the already slow flow of resin 6 from the widely open end to floor 1a. By slowing the flow of resin 6 to floor 1a of core space 1, more time is provided for air to escape from core space 1 to further reduce the chances of residual air 15 becoming entrapped within resin 6. The elimination of trapped air 15 within resin 6 makes it possible to significantly reduce the distortion or breakage of primary housing 2 which would otherwise result from the thermal discharge of primary transformer component 3 expanding residual air 15.

FIG. 4 illustrates a fourth embodiment of the present invention in which open bore 11, which is formed having a diameter smaller than the diameter of core space 1, runs through primary transformer component 3 to connect to core space 1. In this embodiment, open bores 11 may be provided at multiple locations in a radial orientation on primary transformer component 3, and canted downward toward lower surface 2a of primary housing 2 as they approach core space 1. Any appropriate number of bores may be provided. That is, open bores 11 are angled in an upward direction from lower surface 2a of primary housing 2 and extend upward toward the widely open end of core space 1. Furthermore, core space 1 is formed by inclined internal wall 7 as described in the previous embodiments. With the angle of inclined internal wall 7 determined as angle $\beta$ in relation to lower surface 2a of primary housing 2, and with the angle of open bore 11 determined as angle $\alpha$ also in relation to lower surface 2a of primary housing 2, the relationship between angle $\beta$ and angle $\alpha$ can be expressed as $0<\alpha<\beta$.

When orifices such as open bores 11 are provided within primary transformer component 3, and when resin 6 is poured into the region between the perimeter of primary transformer component 3 and primary housing 2 (arrow G), resin 6 gradually enters the region between the perimeter of primary transformer component 3 and primary housing 2 and flows through open bores 11 to fill core space 1 (arrow J). Because open bore 11 approaches core space 1 at a downwardly inclined angle toward lower surface 2a of primary housing 2, resin 6 is able to flow smoothly, of its own weight, in a downward direction from open bore 11 to core space 1. Furthermore, because the diameter of open bore 11 is formed to a dimension smaller than that of core space 1, a small amount of resin 6 continues to flow into core space 1 through open bore 11. This structure prevents resin 6 from quickly covering the floor of core space 1 during inflow, thus preventing the conditions under which residual air 15 can become trapped within resin 6.

Even when resin 6 enters primary housing 2 and flows into the widely open end of core space 1 (arrow I), resin 6 still flows slowly from the widely open end of core space 1 down inclined internal wall 7 as a result of inclined internal wall 7 extending from lower surface 2a of primary housing 2 to form an increasingly larger opening to core space 1. Resin 6 does not quickly cover floor 1a of core space 1, thus preventing the conditions under which residual air 15 can become entrapped within resin 6 flowing into core space 1. Even if residual air 15 in core space 1 should become temporarily entrapped within resin 6 while the resin is still in a liquid condition, the air is allowed to escape to the external perimeter of primary transformer component 3 through open bore 11 (arrow K). In other words, open bore 11 also plays a role in bleeding out residual air 15. This structure therefore further reduces the chances of residual air 15 becoming entrapped within resin 6 as resin 6 flows into core space 1.

As described above, open bores 11, which are provided within primary transformer component 3, allow resin 6 to flow smoothly into core space 1 and also allow residual air 15 to escape without becoming entrapped within resin 6 as the resin flows into core space 1. Both of these mechanisms reduce the chances of residual air 15 becoming entrapped within resin 6 as it flows into core space 1.

The several embodiments of the present invention include many advantages. The noncontact transformer of the present invention includes a primary transformer component installed on the floor surface of a primary housing and immersed within resin that fills the primary housing. An inclined internal wall extends outward from the floor of the primary housing to form a gradually widening core space within the primary transformer component, thus allowing resin that flows into the widely open end of the core space to flow smoothly into the core space along the inclined internal wall as a result of the widely open end of the core space being larger than the part of the core space at the floor, during which time the air present in the core space escapes through the widely open end of the core space. As the resin is able to fill the core space without trapping residual air, potential distortion and other damage to the primary housing, which can be caused by the expansion of air trapped within the resin as a result of heat generated by the operating primary transformer component, are thus further prevented.

The noncontact transformer of the present invention also incorporates, in addition, a cylindrical wall formed in parallel to the axial centerline of the primary transformer component with electrical wire being wound around the cylindrical wall to form the primary transformer component coil. This structure makes it easier to wind the electrical wire that comprises the primary coil, thus providing for a simpler and more economical manufacturing process that makes the transformer more adaptable to mass production.

The noncontact transformer of the present invention, in addition, also includes stepped portions formed at various diameters within the core space of the primary transformer component. Providing the stepped portions at specific distances at points of wider opening extending from the floor of the primary housing of the primary transformer component has the effect of reducing the speed of resin flowing from the widely open end of the core space down to the bottom. This structure provides more time for air within the core space to escape and therefore reduces the chances of air within the core space becoming trapped within the resin. Potential distortion and other damage to the primary housing, which can be caused by the expansion of air trapped within the resin as a result of heat generated by the operating primary transformer component, are thus further prevented.

The noncontact transformer of the present invention also includes open bores that are formed within the primary transformer component and oriented so as to connect to the core space, and formed of a diameter less than the diameter of the core space so as to allow resin, which flows into the region between the primary transformer component and primary housing, to flow slowly through the open bores into the core space and to also allow air within the core space to escape in order to prevent air from becoming trapped within the in-flowing resin. Potential distortion and other damage to the primary housing, which can be caused by the expansion of air trapped within the resin as a result of heat generated by the operating primary transformer component, are thus further prevented.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present disclosure relates to subject matter contained in priority Japanese Application No. 2001-280083, filed on Sep. 14, 2001, which is herein expressly incorporated by reference in its entirety.

What is claimed is:

1. A noncontact transformer including a primary transformer component provided within a primary housing and a secondary transformer component provided within a secondary housing, the transformer components being oriented in mutual opposition to induce noncontact electrical power transmission between the primary transformer component and the secondary transformer component through respective primary and secondary coils, wherein the primary transformer component is attached to a lower surface of the primary housing and is immersed in resin filling the primary housing, said noncontact transformer comprising:

an inclined internal wall defining a core space within the primary transformer component, said inclined internal wall extending from the lower surface of the primary housing to an open end, said open end larger than a portion of said core space at the lower surface of the primary housing.

2. The noncontact transformer according to claim 1, wherein the primary transformer component includes a cylindrical surface parallel to the axis of the primary transformer component, and the primary coil of the primary transformer component includes electrical wire wound around said cylindrical surface.

3. The noncontact transformer according to claim 1, further including a plurality of stepped portions provided at various diameters within said core space of the primary transformer component, said stepped portions located at specific distances at points of wider opening extending from the lower surface of the primary housing of the primary transformer component to said open end of said core space.

4. The noncontact transformer according to claim 1, further including a plurality of open bores provided within the primary transformer component, each of said plurality of open bores extending from a cylindrical surface to connect to said core space, each of said open bores having a diameter less than a diameter of said core space.

5. The noncontact transformer according to claim 1, wherein said portion of said core space at the lower end of the primary housing defines a floor having a diameter A and said open end of said core space defines a widely open end having a diameter B, so that:

$$B>A.$$

6. The noncontact transformer according to claim 1, wherein said inclined internal wall of said core space is configured substantially in a cone shape extending from the lower surface of the primary housing with an increasing diameter toward said open end.

7. The noncontact transformer according to claim 5, further including a plurality of stepped portions provided at various diameters within said core space of the primary transformer component, said stepped portions located at specific distances at points of wider opening extending from the lower surface of the primary housing of the primary transformer component to said open end of said core space.

8. The noncontact transformer according to claim 7, wherein each of said plurality of stepped portions has a height dimension parallel to the axial direction of the primary transformer component of D, so that:

$$D\leq(B-A)/4.$$

9. The noncontact transformer according to claim 7, wherein each of said plurality of stepped portions has a dimension perpendicular to the axial direction of the primary transformer component of C, the primary transformer component has a height E in the axial direction of the primary transformer component, and the lower surface of the primary housing and the primary coil are separated by a distance F, so that:

$$C\leq(E-F)/2.$$

10. The noncontact transformer according to claim 4, wherein each of said plurality of open bores include an internal wall forming a first angle α with the lower surface of the primary housing and said inclined internal wall defining said core space forms a second angle β with the lower surface of the primary housing, so that:

$$0<\alpha<\beta.$$

11. The noncontact transformer according to claim 4, wherein each of said plurality of open bores extends from an external cylindrical surface of the primary transformer component through the primary transformer component toward the lower surface of the primary housing and to said core space, so that each of said plurality of bores is slanted downwardly toward the lower surface of the primary housing.

12. The noncontact transformer according to claim 4, wherein each of said plurality of open bores extends radially from an external cylindrical surface of the primary transformer component through the primary transformer component toward the center of said core space.

13. A primary transformer component for a noncontact transformer, said primary transformer component attached to a lower surface of a primary housing and including a primary coil, said primary transformer component comprising:

an inclined internal wall defining a core space within said primary transformer component, said inclined internal wall extending from the lower surface of the primary housing to an open end, said open end larger than a portion of said core space at the lower surface of the primary housing.

14. The primary transformer component according to claim 13, wherein said primary transformer component includes a cylindrical surface parallel to the axis of said primary transformer component, and the primary coil of said primary transformer component includes electrical wire wound around said cylindrical surface.

15. The primary transformer component according to claim 13, further including a plurality of open bores provided within the primary transformer component, each of said plurality of open bores extending from a cylindrical surface to connect to said core space, each of said open bores having a diameter less than a diameter of said core space.

16. The primary transformer component according to claim 13, wherein said portion of said core space at the lower end of the primary housing defines a floor having a diameter A and said open end of said core space defines a widely open end having a diameter B, so that:

$$B>A.$$

17. The primary transformer component according to claim 13, further including a plurality of stepped portions provided at various diameters within said core space of said primary transformer component, said stepped portions located at specific distances at points of wider opening extending from the lower surface of the primary housing of said primary transformer component to said open end of said core space.

18. The primary transformer component according to claim 16, further including a plurality of stepped portions provided at various diameters within said core space of said primary transformer component, said stepped portions located at specific distances at points of wider opening extending from the lower surface of the primary housing of said primary transformer component to said open end of said core space;

wherein each of said plurality of stepped portions has a height dimension parallel to the axial direction of said primary transformer component of D, so that:

$$D\leq(B-A)/4.$$

19. The primary transformer component according to claim 16, further including a plurality of stepped portions provided at various diameters within said core space of said primary transformer component, said stepped portions located at specific distances at points of wider opening extending from the lower surface of the primary housing of said primary transformer component to said open end of said core space;

wherein each of said plurality of stepped portions has a dimension perpendicular to the axial direction of said primary transformer component of C, said primary transformer component has a height E in the axial direction of said primary transformer component, and the lower surface of the primary housing and the primary coil are separated by a distance F, so that:

$$C\leq(E-F)/2.$$

20. The primary transformer component according to claim 15, wherein each of said plurality of open bores include an internal wall forming a first angle $\alpha$ with the lower surface of the primary housing and said inclined internal wall defining said core space forms a second angle $\beta$ with the lower surface of the primary housing, so that:

$$0<\alpha<\beta.$$

21. The primary transformer component according to claim 13, wherein said primary transformer component is immersed in resin filling the primary housing.

22. In combination, a rechargeable electric appliance;

a noncontact transformer; and a primary transformer component according to claim 13.

* * * * *